US010227995B2

(12) United States Patent
Oda et al.

(10) Patent No.: US 10,227,995 B2
(45) Date of Patent: Mar. 12, 2019

(54) TURBO COMPRESSOR AND TURBO REFRIGERATING MACHINE

(71) Applicant: DAIKIN INDUSTRIES, LTD., Osaka-shi, Osaka (JP)

(72) Inventors: Kentarou Oda, Tokyo (JP); Nobuyoshi Sakuma, Tokyo (JP)

(73) Assignee: Daikin Industries, Ltd., Osaka-shi, Osaka (JP)

( * ) Notice: Subject to any disclaimer, the term of this patent is extended or adjusted under 35 U.S.C. 154(b) by 555 days.

(21) Appl. No.: 14/903,232

(22) PCT Filed: Jul. 8, 2014

(86) PCT No.: PCT/JP2014/068190
§ 371 (c)(1),
(2) Date: Jan. 6, 2016

(87) PCT Pub. No.: WO2015/005343
PCT Pub. Date: Jan. 15, 2015

(65) Prior Publication Data

US 2016/0153471 A1 Jun. 2, 2016

(30) Foreign Application Priority Data

Jul. 10, 2013 (JP) ..... 2013-144506

(51) Int. Cl.
*F04D 29/70* (2006.01)
*F04D 25/06* (2006.01)
(Continued)

(52) U.S. Cl.
CPC ..... *F04D 29/701* (2013.01); *F04D 17/10* (2013.01); *F04D 25/06* (2013.01); *F04D 29/083* (2013.01);
(Continued)

(58) Field of Classification Search
CPC ..... F04D 25/06; F04D 17/10; F04D 17/12; F04D 29/083; F04D 29/284; F04D 29/701
See application file for complete search history.

(56) References Cited

U.S. PATENT DOCUMENTS 2,397,327 A * 3/1946 Pratt ..... F02M 1/00 261/24
4,930,978 A * 6/1990 Khanna ..... F04D 29/4213 415/58.3
(Continued)

FOREIGN PATENT DOCUMENTS

JP 59-180002 A 10/1984
JP 9-4585 A 1/1997
(Continued)

OTHER PUBLICATIONS

International Search Report, issued in PCT/JP2014/068190, dated Sep. 30, 2014.
(Continued)

*Primary Examiner* — Woody A Lee, Jr.
(74) *Attorney, Agent, or Firm* — Birch, Stewart, Kolasch & Birch, LLP

(57) ABSTRACT

Provided are a turbo compressor which is provided with an impeller rotating about a rotating shaft, and a seal part having a facing portion which faces an outer diameter portion of a hub of the impeller in a radial direction, in which a shunting groove for foreign matter which has infiltrated between the outer diameter portion and the facing portion is formed in the seal part, and a turbo refrigerating machine which is provided with the turbo compressor.

16 Claims, 7 Drawing Sheets

(51) Int. Cl.

| | |
|---|---|
| ***F25B 1/053*** | (2006.01) |
| ***F04D 17/10*** | (2006.01) |
| ***F04D 29/08*** | (2006.01) |
| ***F04D 29/28*** | (2006.01) |
| ***F04D 29/42*** | (2006.01) |

(52) U.S. Cl.
CPC ..... *F04D 29/284* (2013.01); *F04D 29/289* (2013.01); *F04D 29/4206* (2013.01); *F25B 1/053* (2013.01); *F05D 2260/4031* (2013.01); *F05D 2260/607* (2013.01); *F25B 2400/13* (2013.01); *F25B 2400/23* (2013.01)

(56) References Cited

U.S. PATENT DOCUMENTS

| | | | | | |
|---|---|---|---|---|---|
| 5,190,440 | A * | 3/1993 | Maier | F01D 11/02 | 277/412 |
| 5,425,345 | A * | 6/1995 | Lawrence | F02B 33/40 | 123/559.1 |
| 2007/0147985 | A1 * | 6/2007 | Takahashi | F04D 17/12 | 415/104 |
| 2009/0193840 | A1 | 8/2009 | Kurihara et al. | | |
| 2011/0016916 | A1 | 1/2011 | Tsukamoto et al. | | |

FOREIGN PATENT DOCUMENTS

| | | | | | |
|---|---|---|---|---|---|
| JP | 10-26005 | A | | 1/1998 | |
| JP | 10-089291 | | * | 4/1998 | F04D 29/42 |
| JP | 10-89291 | A | | 4/1998 | |
| JP | 2002-242699 | A | | 8/2002 | |
| JP | 2005-42714 | A | | 2/2005 | |
| JP | 2009-185715 | A | | 8/2009 | |
| JP | 2011-26958 | A | | 2/2011 | |
| JP | 2012-77642 | A | | 4/2012 | |

OTHER PUBLICATIONS

Extended European Search Report for European Application No. 14823800.9, dated Feb. 23, 2017.

* cited by examiner

TURBO COMPRESSOR AND TURBO REFRIGERATING MACHINE

TECHNICAL FIELD

The present invention relates to a turbo compressor and a turbo refrigerating machine.

Priority is claimed on Japanese Patent Application No. 2013-144506, filed on Jul. 10, 2013, the content of which is incorporated herein by reference.

BACKGROUND ART

As a refrigerating machine, a turbo refrigerating machine which is provided with a turbo compressor which compresses a refrigerant by rotating an impeller by an electric motor is known. In the turbo compressor, a diffuser flow path is provided around the impeller, and a refrigerant led out in a radial direction by the rotation of the impeller is pressurized in the diffuser flow path, and the pressurized refrigerant is introduced into a scroll flow path. The diffuser flow path is provided in a casing and smoothly communicates with a hub of the impeller (refer to, for example, Patent Document 1).

Patent Document 2 discloses a collecting port which is provided by machining a portion of the casing configuring the diffuser flow path and the scroll flow path in a gas turbine engine having a centrifugal compressor and captures foreign matter contained in the air that is a working fluid. The collecting port is formed in an endmost portion in a radial direction of the diffuser flow path (refer to Paragraphs [0017] and [0018] and FIGS. 1 and 2 of Patent Document 2).

Patent Document 3 discloses a configuration in which in a centrifugal compressor which compresses gas, foreign matter contained in the gas is prevented from infiltrating into the back surface of the impeller by supplying buffer gas to the back surface of the impeller and causing the buffer gas to flow through the gap between the back surface of the impeller formed in a smooth surface and the casing toward the outside in a radial direction of the back surface of the impeller. The buffer gas flows through the gap and joins a main stream of the gas flowing through a diffuser flow path from a gap 4*a* between an outer periphery 1*c* of the impeller and the casing (refer to Abstract and FIGS. 1 and 2 of Patent Document 3).

Patent Document 4 discloses a configuration in which in a turbo refrigerating machine provided with a turbo compressor, a first impeller and a second impeller are fixed to a rotating shaft and the rotating shaft is supported on a bearing (from Abstract of Patent Document 4).

CITATION LIST

Patent Document

[Patent Document 1] Japanese Unexamined Patent Application, First Publication No. 2011-26958

[Patent Document 2] Japanese Unexamined Patent Application, First Publication No. 2002-242699

[Patent Document 3] Japanese Unexamined Patent Application, First Publication No. 2012-77642

[Patent Document 4] Japanese Unexamined Patent Application, First Publication No. 2009-185715

SUMMARY OF INVENTION

Technical Problem

An impeller which is a rotating body, and a fixed member such as a casing which faces an outer diameter portion of a hub of the impeller are formed of different materials (for example, the impeller is made of aluminum and the casing is made of cast iron). Accordingly, even if some foreign matter (dust, welding slag, or the like) becomes caught between the impeller and the fixed member, it does not result in large seizure.

However, depending on the configuration of a turbo compressor, there is a case where an impeller and a fixed member inevitably have to be formed of the same materials. Then, when foreign matter becomes caught, seizure is caused between the impeller and the fixed member, and furthermore, there is a possibility that weld penetration may occur.

The present invention has been made in view of the above-described circumstances and has an object to provide a turbo compressor and a turbo refrigerating machine in which it is possible to prevent seizure between an impeller and a fixed member.

Solution to Problem

According to a first aspect of the present invention, there is provided a turbo compressor including: an impeller which rotates about a rotating shaft; and a fixed member having a facing portion which faces an outer diameter portion of a hub of the impeller in a radial direction, in which a shunting groove for the foreign matter which has infiltrated between the outer diameter portion and the facing portion is formed in at least one of the impeller and the fixed member.

In the first aspect of the present invention, the shunting groove is provided in at least one of the impeller and the fixed member, thereby forming an escape route for the foreign matter which has infiltrated between the impeller and the fixed member. Accordingly, in the first aspect of the present invention, even if the foreign matter infiltrates between the impeller and the fixed member, the foreign matter escapes into the shunting groove, and thus foreign matter being caught can be prevented. Therefore, it is possible to prevent seizure between the impeller and the fixed member.

In a second aspect of the present invention, in accordance with the first aspect, the shunting groove is partially formed in the facing portion of the fixed member.

In the second aspect of the present invention, the shunting groove is formed in the facing portion of a stationary fixed member which faces the outer diameter of the impeller, and therefore, it is possible to cause the foreign matter which has infiltrated between the impeller and the fixed member to be confined in the shunting groove by using a rotating force rotating in a circumferential direction of the impeller and a centrifugal force acting toward the outside in a radial direction of the impeller which both act on the foreign matter. Furthermore, the shunting groove is partially formed in the facing portion, and therefore, in a portion in which the shunting groove is not formed, the impeller and the facing portion smoothly communicate with each other, and therefore, the ability of the gas to flow is not inhibited.

In a third aspect of the present invention, in accordance with the first or second aspect, the fixed member is a labyrinth seal which seals the back side of the impeller.

In the third aspect of the present invention, even if the labyrinth seal is extended, thereby being made to face the outer diameter portion of the hub of the impeller in the radial direction, the shunting groove is provided, whereby it is possible to prevent seizure between the impeller and the labyrinth seal.

In a fourth aspect of the present invention, in accordance with any one of the first to third aspects, the shunting groove is a countersink for a screw member fixing the fixed member.

In the fourth aspect of the present invention, the countersink configured to stabilize the positioning of the screw member, which fixes the fixed member, functions as the shunting groove, whereby the countersink and the shunting groove are not separately machined, and thus the amount of machining can be reduced.

In a fifth aspect of the present invention, in accordance with any one of the first to fourth aspects, a plurality of the shunting grooves are formed, and the shunting groove which is located on the lowermost side, among the plurality of shunting grooves, is formed to be larger than the other shunting grooves.

In the fifth aspect of the present invention, more foreign matter is deposited in the shunting groove which is located on the lowermost side, among the plurality of shunting grooves, than in the other shunting grooves due to the force of gravity, and therefore, the shunting groove is formed to be relatively large, whereby it is possible to effectively prevent the overflow of foreign matter.

In a sixth aspect of the present invention, in accordance with any one of the first to fifth aspects, the impeller and the fixed member are formed of the same materials.

In the sixth aspect of the present invention, even in a case where the impeller and the fixed member are formed of the same materials, the shunting groove is provided, whereby it is possible to prevent seizure between the impeller and the fixed member.

In a seventh aspect of the present invention, there is provided a turbo refrigerating machine including: a condenser which liquefies a compressed refrigerant; an evaporator which evaporates the refrigerant liquefied by the condenser, thereby cooling a cooling object; and the turbo compressor according to any one of the first to sixth aspects, which compresses the refrigerant evaporated by the evaporator and supplies the compressed refrigerant to the condenser.

In the seventh aspect of the present invention, a turbo refrigerating machine in which it is possible to prevent seizure between the impeller and the fixed member in the turbo compressor is obtained.

In an eighth aspect of the present invention, in accordance with the first aspect, in a case where the shunting groove is formed in the impeller, the shunting groove is a groove partially formed in the outer diameter portion of the hub of the impeller, and in a case where the shunting groove is formed in the fixed member, the shunting groove is a groove partially formed in the facing portion of the fixed member.

Advantageous Effects of Invention

According to the present invention, a turbo compressor and a turbo refrigerating machine are obtained in which it is possible to prevent seizure between an impeller and a fixed member.

DESCRIPTION OF EMBODIMENTS

Hereinafter, an apparatus of an embodiment of the present invention will be described with reference to the drawings.

Figure 1:
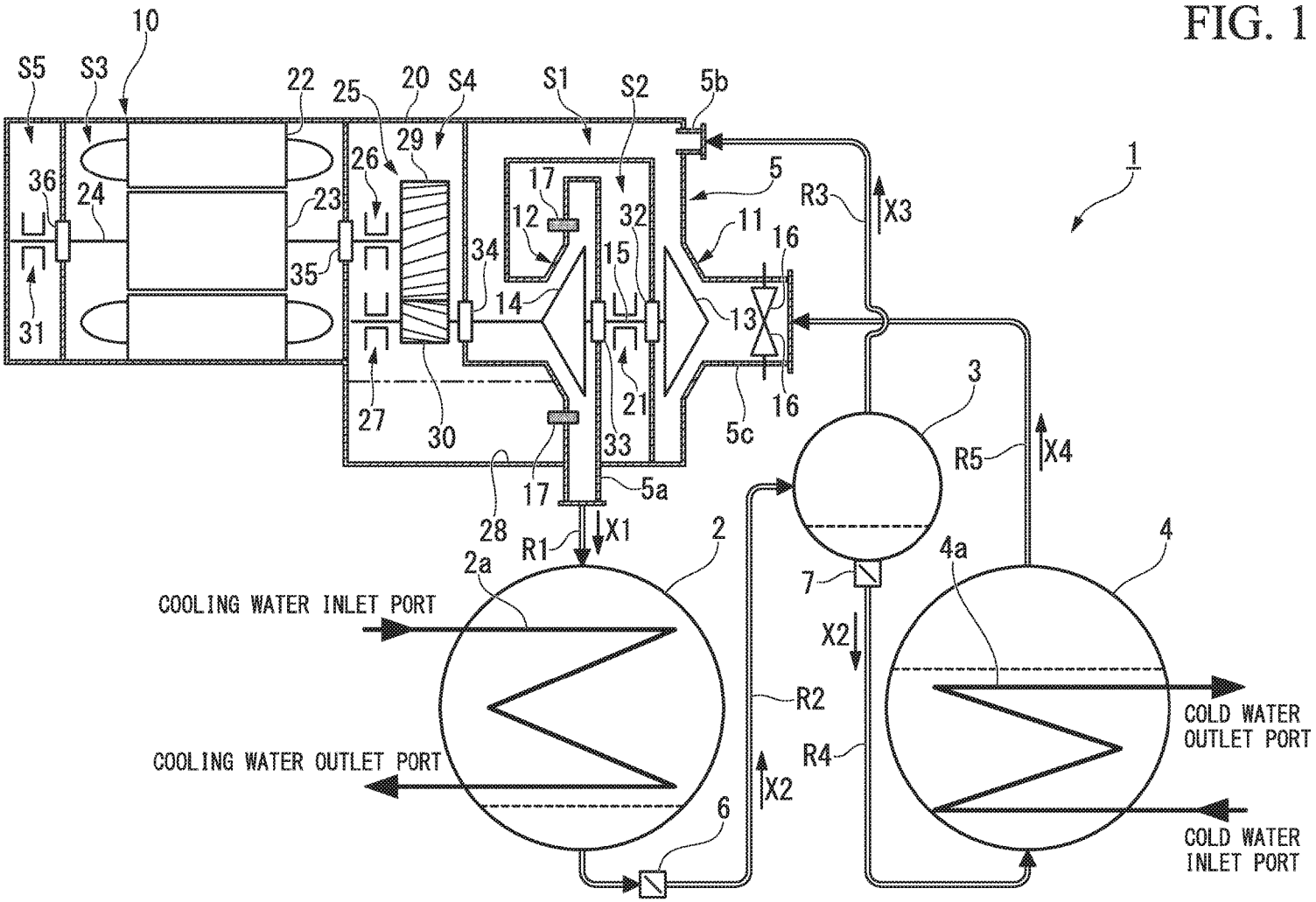
FIG. 1 is a system diagram of a turbo refrigerating machine in an embodiment of the present invention.

FIG. 1 is a system diagram of a turbo refrigerating machine 1 in an embodiment of the present invention. In the turbo refrigerating machine 1 of this embodiment, for example, a chlorofluorocarbon is used as a refrigerant and cold water for air conditioning is set to be a cooling object. The turbo refrigerating machine 1 is provided with a condenser 2, an economizer 3, an evaporator 4, and a turbo compressor 5, as shown in FIG. 1.

The condenser 2 is connected to a gas discharge pipe 5*a* of the turbo compressor 5 through a flow path R1. A refrigerant (a compressed refrigerant gas X1) compressed by the turbo compressor 5 is supplied to the condenser 2 through the flow path R1. The condenser 2 liquefies the compressed refrigerant gas X1. The condenser 2 is provided with a heat exchanger tube 2*a* through which cooling water flows, and cools the compressed refrigerant gas X1 by heat exchange between the compressed refrigerant gas X1 and the cooling water.

The compressed refrigerant gas X1 is cooled and liquefied by heat exchange between itself and the cooling water, thereby becoming a refrigerant liquid X2, and the refrigerant liquid X2 accumulates in a bottom portion of the condenser 2. The bottom portion of the condenser 2 is connected to the economizer 3 through a flow path R2. An expansion valve 6 for decompressing the refrigerant liquid X2 is provided in the flow path R2. The refrigerant liquid X2 decompressed by the expansion valve 6 is supplied to the economizer 3 through the flow path R2. The economizer 3 temporarily stores the decompressed refrigerant liquid X2 and separates the refrigerant into a liquid phase and a gas phase.

A top portion of the economizer 3 is connected to an economizer connecting pipe 5*b* of the turbo compressor 5 through a flow path R3. A gas-phase component X3 of the refrigerant separated out by the economizer 3 is supplied to a second compression stage 12 of the turbo compressor 5 through the flow path R3 without passing through the evaporator 4 and a first compression stage 11, and thus the efficiency of the turbo compressor 5 is increased. On the other hand, a bottom portion of the economizer 3 is connected to the evaporator 4 through a flow path R4. An expansion valve 7 for further decompressing the refrigerant liquid X2 is provided in the flow path R4.

The refrigerant liquid X2 further decompressed by the expansion valve 7 is supplied to the evaporator 4 through the flow path R4. The evaporator 4 evaporates the refrigerant liquid X2 and cools cold water using the heat of vaporization. The evaporator 4 is provided with a heat exchanger tube 4*a* through which the cold water flows, and causes the cooling of the cold water and the evaporation of the refrigerant liquid X2 by heat exchange between the refrigerant liquid X2 and the cold water. The refrigerant liquid X2 evaporates by taking in heat by heat exchange between itself and the cold water, thereby becoming a refrigerant gas X4.

A top portion of the evaporator 4 is connected to a gas suction pipe 5*c* of the turbo compressor 5 through a flow path R5. The refrigerant gas X4 having evaporated in the evaporator 4 is supplied to the turbo compressor 5 through the flow path R5. The turbo compressor 5 compresses the refrigerant gas X4 having evaporated and supplies it to the condenser 2 as the compressed refrigerant gas X1. The turbo compressor 5 is a two-stage compressor which is provided with the first compression stage 11 which compresses the refrigerant gas X4, and the second compression stage 12 which further compresses the refrigerant compressed in one step.

An impeller 13 is provided in the first compression stage 11, an impeller 14 is provided in the second compression stage 12, and these impellers are connected by a rotating shaft 15. The turbo compressor 5 compresses the refrigerant by rotating the impellers 13 and 14 by an electric motor 10. Each of the impellers 13 and 14 is a radial impeller and has a blade which includes a three-dimensional twist (not shown) that radially leads out the refrigerant suctioned thereinto from an axial direction.

An inlet guide vane 16 for regulating the intake amount of the first compression stage 11 is provided in the gas suction pipe 5*c*. The inlet guide vane 16 is made to be rotatable such that an apparent area from a flow direction of the refrigerant gas X4 can be changed. A diffuser flow path is provided around each of the impellers 13 and 14, and the refrigerant led out in a radial direction is compressed and increased in pressure in the diffuser flow path. Furthermore, it is possible to supply the refrigerant to the next compression stage by a scroll flow path further provided around the diffuser flow path. An outlet throttle valve 17 is provided around the impeller 14 so that the discharge amount from the gas discharge pipe 5*a* can be controlled.

The turbo compressor 5 is provided with a hermetic type casing 20. The casing 20 is partitioned into a compression flow path space S1, a first bearing accommodation space S2, a motor accommodation space S3, a gear unit accommodation space S4, and a second bearing accommodation space S5. The impellers 13 and 14 are provided in the compression flow path space S1. The rotating shaft 15 connecting the impellers 13 and 14 is provided to pass through the compression flow path space S1, the first bearing accommodation space S2, and the gear unit accommodation space S4. A bearing 21 supporting the rotating shaft 15 is provided in the first bearing accommodation space S2.

A stator 22, a rotor 23, and a rotating shaft 24 connected to the rotor 23 are provided in the motor accommodation space S3. The rotating shaft 24 is provided to pass through the motor accommodation space S3, the gear unit accommodation space S4, and the second bearing accommodation space S5. A bearing 31 supporting the anti-load side of the rotating shaft 24 is provided in the second bearing accommodation space S5. A gear unit 25, bearings 26 and 27, and an oil tank 28 are provided in the gear unit accommodation space S4.

The gear unit 25 has a large-diameter gear 29 which is fixed to the rotating shaft 24, and a small-diameter gear 30 which is fixed to the rotating shaft 15 and engaged with the large-diameter gear 29. The gear unit 25 transmits a rotating force such that the rotational frequency of the rotating shaft 15 increases with respect to the rotational frequency of the rotating shaft 24 (the rotational speed of the rotating shaft 15 increases). The bearing 26 supports the rotating shaft 24. The bearing 27 supports the rotating shaft 15. The oil tank 28 stores lubricating oil which is supplied to the respective sliding sites such as the bearings 21, 26, 27, and 31.

Seal parts 32 and 33 which seal the periphery of the rotating shaft 15 are provided in the casing 20 between the compression flow path space S1 and the first bearing accommodation space S2. Furthermore, a seal part 34 which seals the periphery of the rotating shaft 15 is provided in the casing 20 between the compression flow path space S1 and the gear unit accommodation space S4. Furthermore, a seal part 35 which seals the periphery of the rotating shaft 24 is provided in the casing 20 between the gear unit accommodation space S4 and the motor accommodation space S3. Furthermore, a seal part 36 which seals the periphery of the rotating shaft 24 is provided in the casing 20 between the motor accommodation space S3 and the second bearing accommodation space S5.

Figure 2:
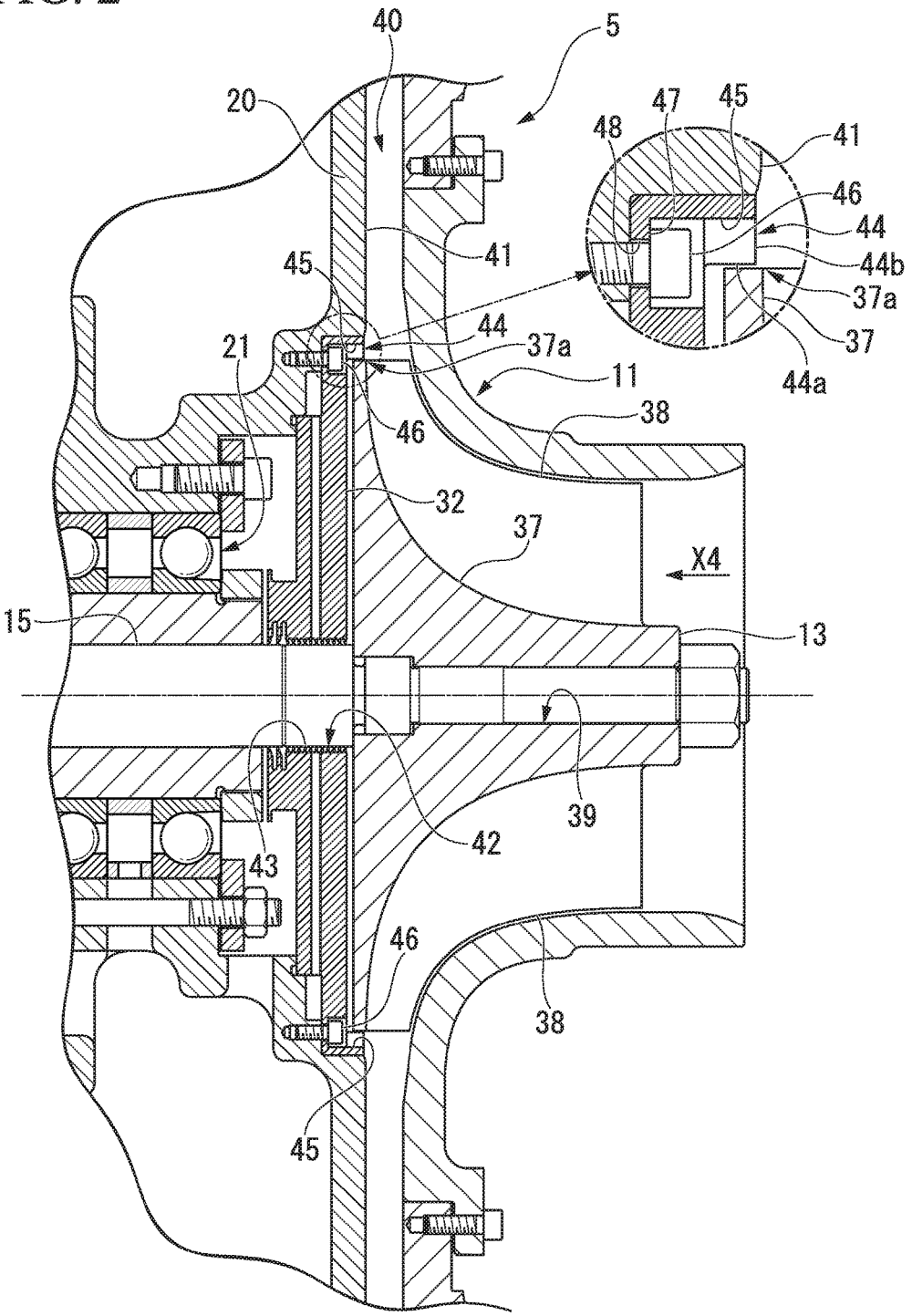
FIG. 2 is an enlarged view of a main section of a turbo compressor in the embodiment of the present invention.
Figure 3:
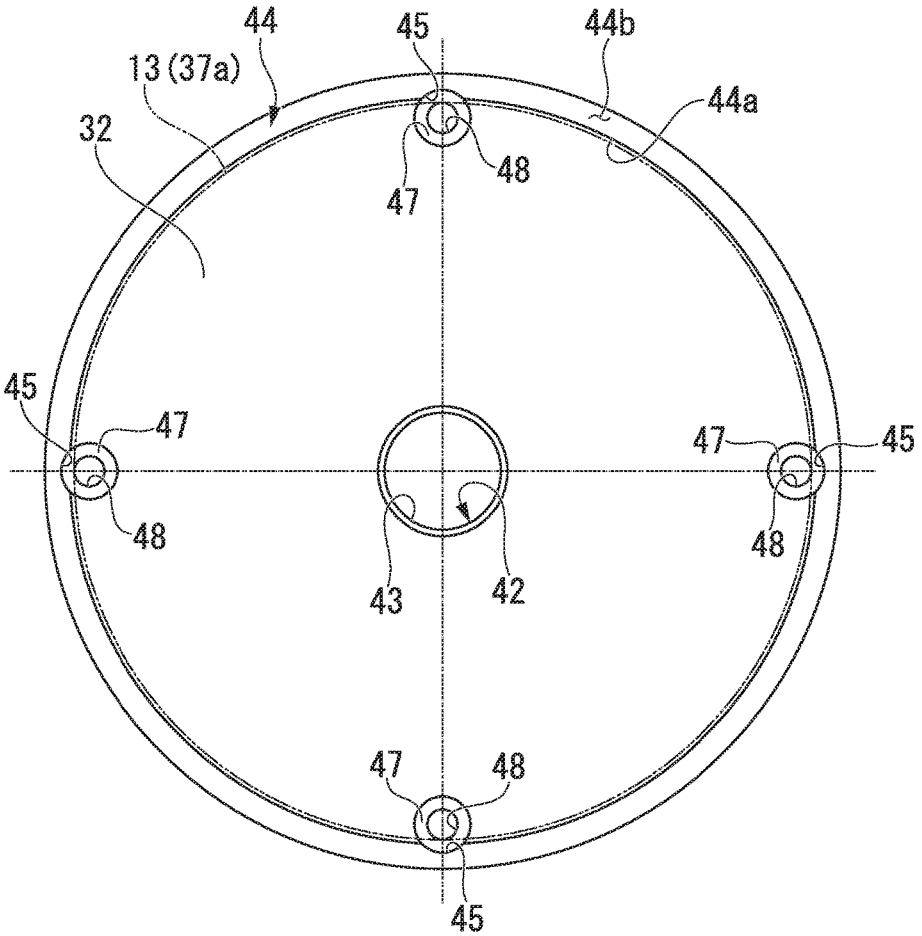
FIG. 3 is a diagram showing the disposition and the configuration of a shunting groove provided in a seal part in the embodiment of the present invention.

FIG. 2 is an enlarged view of a main section of the turbo compressor 5 in the embodiment of the present invention. In addition, FIG. 2 is an enlarged view in the first compression stage 11 of the turbo compressor 5. FIG. 3 is a diagram showing the disposition and the configuration of a shunting groove 45 provided in the seal part 32 in the embodiment of the present invention.

As shown in FIG. 2, the impeller 13 is integrally fixed to the rotating shaft 15. The impeller 13 of this embodiment is a radial impeller and is made of lightweight aluminum having high rotational stability in a high rotation range.

The impeller 13 has a hub 37, and a plurality of blades 38 are provided at the hub 37. A through-hole 39 is formed at the center of the hub 37, and the rotating shaft 15 is inserted into the through-hole 39 and fixed thereto by a nut. The rotating shaft 15 of this embodiment is a different material from the impeller 13 and is made of, for example, iron.

A diffuser flow path 40 is provided radially outside of the impeller 13. The diffuser flow path 40 decelerates and pressurizes the refrigerant gas X4 discharged in a radial direction from the impeller 13. The diffuser flow path 40 has a flow path surface 41 which is formed by the casing 20 and smoothly communicates with the hub 37 of the impeller 13. The casing 20 of this embodiment is a different material from the impeller 13 and is made of, for example, iron.

The seal part 32 (a fixed member) is provided on the back side of the impeller 13. The seal part 32 is a labyrinth seal which prevents leakage of the refrigerant gas X4 from the periphery of the rotating shaft 15.

A through-hole 42 is formed at the center of the seal part 32, and the rotating shaft 15 is inserted into the through-hole 42. Furthermore, a plurality of seal fins 43 are formed on the inner peripheral surface of the through-hole 42. The seal part 32 of this embodiment is a different material from the rotating shaft 15 which is a rotating body, and is made of aluminum.

The seal part 32 is provided with a facing portion 44 which faces an outer diameter portion 37*a* of the hub 37 of the impeller 13 in a radial direction. The seal part 32 of this embodiment is enlarged in diameter to be larger than the impeller 13 and is provided with the facing portion 44 protruding from a peripheral edge portion thereof. The facing portion 44 is formed in an annular shape, as shown in FIG. 3. Furthermore, the facing portion 44 has a facing surface 44*a* facing the outer diameter portion 37*a* of the impeller 13, and a relay flow path surface 44*b* performing a relay between the hub 37 of the impeller 13 and the flow path surface 41, as shown in FIG. 2.

In the turbo compressor according to the related art, a configuration is made such that members corresponding to the hub 37 of the impeller 13 and the flow path surface 41 of the casing 20 in this embodiment are directly connected. In contrast, the turbo compressor 5 of this embodiment is configured such that the hub 37 of the impeller 13 and the flow path surface 41 of the casing 20 are connected through the facing portion 44 of the seal part 32. In this embodiment, in terms of the performance of the turbo compressor 5, the impeller 13 is made to be smaller, and in terms of the manufacturing cost of the turbo compressor 5, the size of the casing 20 having a complicated shape is fixed.

However, if the impeller 13 is made to be small relative to the casing 20, a gap is generated between the hub 37 of the impeller 13 and the flow path surface 41 of the casing 20, and thus the ability of the refrigerant gas X4 to flow is inhibited. Therefore, in this embodiment, the seal part 32 is extended, thereby forming the facing portion 44 which faces the outer diameter portion 37*a* of the hub 37 of the impeller 13 in the radial direction, and the gap is eliminated by the facing portion 44, whereby a relay between the hub 37 of the impeller 13 and the flow path surface 41 is made.

Incidentally, the seal part 32 is a labyrinth seal for the rotating shaft 15. The seal part 32 is made of aluminum which is a different material from the rotating shaft 15 in order to prevent seizure between itself and the rotating shaft 15. On the other hand, the impeller 13 is also made of aluminum for rotational stability. Then, the impeller 13 and the seal part 32 inevitably have to be made of the same members, and thus if foreign matter (small dust which is included in the refrigerant gas X4, melted slag eluted from a welding structure, or the like) becomes caught between the outer diameter portion 37*a* and the facing portion 44, there is a case where seizure between the impeller 13 and the seal part 32 occurs.

Therefore, in this embodiment, because of the foreign matter which has infiltrated between the outer diameter portion 37*a* of the impeller 13 and the facing portion 44 of the seal part 32, the shunting groove 45 is formed. The shunting groove 45 of this embodiment is partially formed in the facing portion 44 of the seal part 32 which is a stationary part with respect to the impeller 13, as shown in FIG. 3. The shunting grooves 45 are formed at four upper, lower, right, and left locations in the facing portion 44. In other words, four shunting grooves 45 are formed at 90° intervals in a circumferential direction.

The shunting groove 45 is a groove formed by partially gouging out the facing portion 44 in an arc shape. Accordingly, at a portion in which the shunting groove 45 is formed, a distance from the outer diameter portion 37*a* of the impeller 13 is formed to be larger than in the other portion. The depth of the shunting groove 45 is set to correspond to the size of the foreign matter. That is, the shunting groove 45 is formed to be at least a size large enough for the foreign matter, which is predicted to become caught, to escape.

The seal part 32 is fixed to the casing 20 by a screw member 46, as shown in FIG. 2. The shunting groove 45 of this embodiment is machined as a countersink 47 for stabilizing the sitting of the screw member 46. As shown in FIG. 3, the seal part 32 has a plurality of through-holes 48 into each of which the screw member 46 is inserted. The through-hole 48 is provided adjacent to the facing portion 44, and the countersink 47 is formed around the through-hole 48, whereby the shunting groove 45 can be formed. In this way, the shunting groove 45 and the countersink 47 are not separately machined, and thus the amount of machining can be reduced.

Subsequently, an action by the shunting groove 45 having the above configuration will be described.

In the turbo compressor 5 of this embodiment, in view of its configuration, it is necessary to inevitably make the impeller 13 and the seal part 32 members having the same materials. If the above-mentioned small foreign matter infiltrates and becomes caught between the outer diameter portion 37*a* of the impeller 13 and the facing portion 44 of the seal part 32, thereby causing seizure to occur, for example, large weld penetration occurs at the outer diameter portion 37*a* of the impeller 13. For this reason, the rotational performance of the impeller 13 or gas flow performance decreases, and thus there is a case where replacement, repair, or the like of the impeller 13 is required.

Therefore, in this embodiment, as shown in FIGS. 2 and 3, the shunting groove 45 is provided in the seal part 32, and thus an escape route for the foreign matter which has infiltrated between the impeller 13 and the seal part 32 is formed. In this way, even if the above-mentioned small foreign matter infiltrates between the impeller 13 and the seal part 32, the foreign matter can escape into the shunting groove 45. Therefore, according to this embodiment, the foreign matter becoming caught between the outer diameter portion 37*a* of the impeller 13 and the facing portion 44 of the seal part 32 can be prevented, and therefore, it is possible to prevent seizure between the impeller 13 and the seal part 32.

Furthermore, in this embodiment, the shunting groove 45 is formed in the facing portion 44 of the seal part 32 which faces to be stationary with respect to the outer diameter of the impeller 13, and therefore, it is possible to cause the foreign matter which has infiltrated between the impeller 13 and the seal part 32 to be confined in the shunting groove 45 by using a rotating force rotating in the circumferential direction of the impeller 13 and a centrifugal force acting toward the outside in the radial direction of the impeller 13 which both act on the foreign matter. Therefore, according to this embodiment, it is possible to capture the foreign matter which has escaped into the shunting groove 45 and thus prevent the foreign matter from infiltrating and becoming caught between the impeller 13 and the seal part 32 again.

Furthermore, the shunting groove 45 is partially formed in the facing portion 44, as shown in FIG. 3, and therefore, it is possible to secure a wide relay flow path surface 44*b*. In this way, the hub 37 of the impeller 13 and the flow path surface 41 of the casing 20 smoothly communicate with each other over substantially the entire area by the relay flow path surface 44*b* of the facing portion 44. Therefore, even if the shunting groove 45 is provided, the ability of the refrigerant gas X4 to flow is not inhibited.

As described above, in this embodiment, even if the seal part 32 made of aluminum is extended, thereby being made to face the outer diameter portion 37*a* of the hub 37 of the impeller 13 in the radial direction, the shunting groove 45 is provided, whereby it is possible to effectively prevent seizure between the impeller 13 and the seal part 32 which are formed of the same materials.

Therefore, according to the embodiment described above, the turbo compressor 5 is provided with the impeller 13 rotating about the rotating shaft 15, and the seal part 32 which is provided with the facing portion 44 facing the outer diameter portion 37*a* of the hub 37 of the impeller 13 in the radial direction, in which the shunting groove 45 for the foreign matter which has infiltrated between the outer diameter portion 37*a* and the facing portion 44 is formed in the seal part 32. For this reason, the turbo compressor 5 and the turbo refrigerating machine 1 are obtained in which it is possible to prevent seizure between the impeller 13 and the seal part 32.

The preferred embodiment of the present invention has been described above with reference to the drawings. However, the present invention is not limited to the embodiment described above. The shapes, the combination, or the like of the respective constituent members shown in the embodiment described above is one example and various changes can be made based on design requirements or the like within a scope of the present invention.

For example, the present invention may adopt the forms shown in FIGS. 4 to 7 below. In addition, in the following description, constituent portions equal or equivalent to those in the above-described embodiment are denoted by the same reference numerals and descriptions thereof are simplified or omitted.

Figure 4:
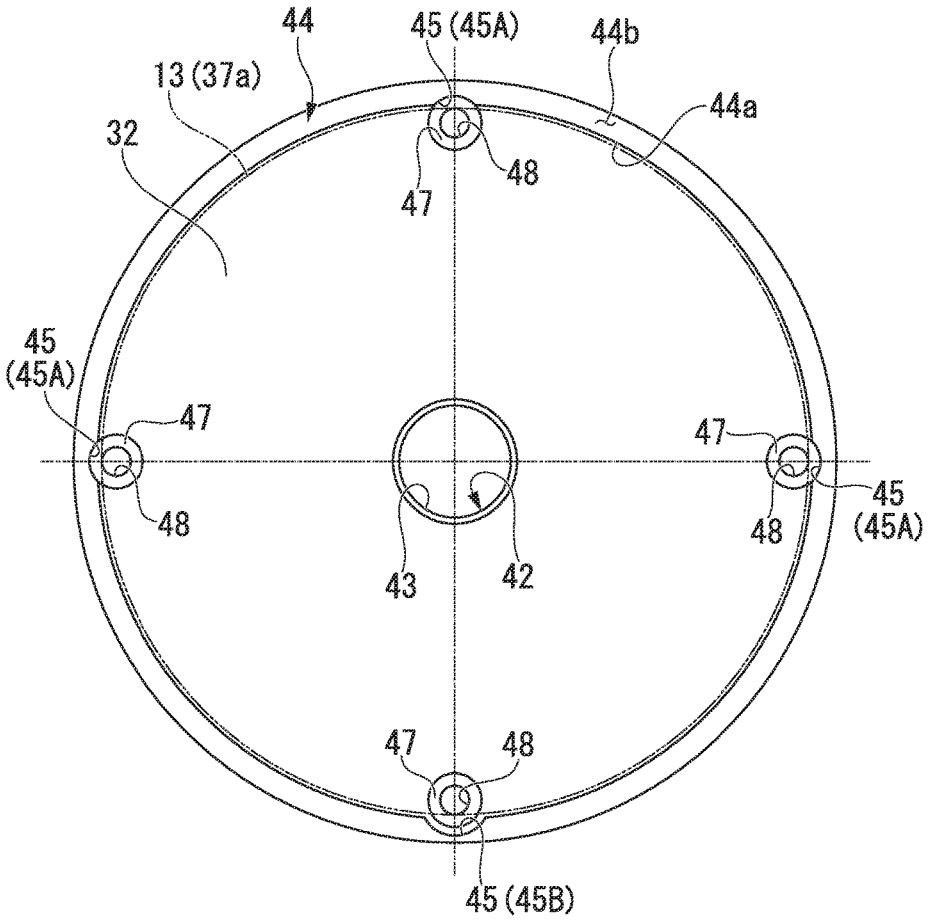
FIG. 4 is a diagram showing the disposition and the configuration of a shunting groove provided in the seal part in another embodiment of the present invention.

FIG. 4 is a diagram showing the disposition and the configuration of the shunting groove 45 provided in the seal part 32 in another embodiment of the present invention.

As shown in FIG. 4, the plurality of shunting grooves 45 are formed in the facing portion 44, and a shunting groove 45B which is located on the lowermost side, among the plurality of shunting grooves 45, is formed to be larger than other shunting grooves 45A. Specifically, the shunting groove 45B is formed to have a radius larger than the radius of the countersink 47.

According to this configuration, more foreign matter can be accommodated in the shunting groove 45B which is located on the lowermost side. That is, more foreign matter is deposited in the shunting groove 45B which is located on the lowermost side, among the plurality of shunting grooves 45, than in the other shunting groove 45A due to the force of gravity. Therefore, the shunting groove 45B is formed to be relatively large, whereby it is possible to effectively prevent the overflow of the accommodated foreign matter.

Figure 5A:
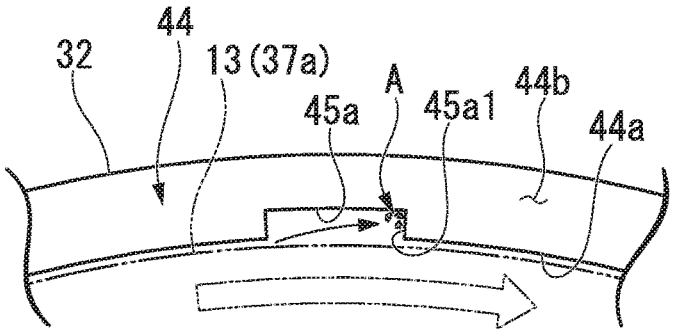
FIG. 5A is a diagram showing the configuration of a shunting groove in another embodiment of the present invention.
Figure 5B:
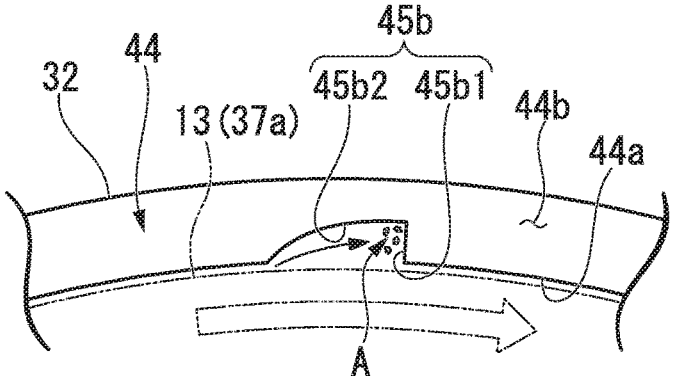
FIG. 5B is a diagram showing the configuration of a shunting groove in another embodiment of the present invention.
Figure 5C:
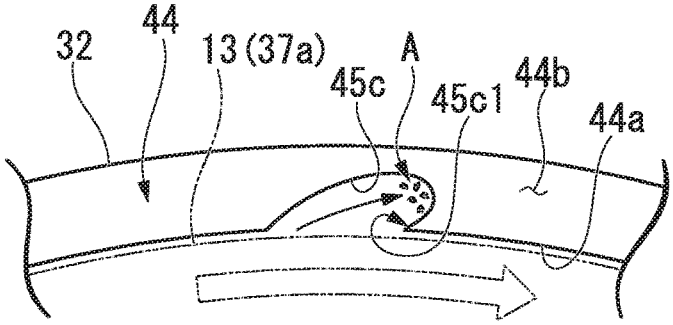
FIG. 5C is a diagram showing the configuration of a shunting groove in another embodiment of the present invention.

FIGS. 5A to 5C are diagrams showing shunting grooves 45*a*, 45*b*, and 45*c* in another embodiment of the present invention. In addition, a symbol A in FIGS. 5A to 5C indicates the foreign matter schematically shown.

The shunting groove 45*a* shown in FIG. 5A is formed in a rectangular shape. The shunting groove 45*a* has a wall surface 45*a*1 which is a wall relative to the rotation direction of the impeller 13 and extends in a normal direction to the rotation trajectory of the impeller 13. According to this configuration, it is possible to make it easy for the foreign matter which is entrained by the rotation of the impeller 13 to be trapped on the wall surface 45*a*1, thereby remaining in the shunting groove 45*a*.

The shunting groove 45*b* shown in FIG. 5B has a wall surface 45*b*1 which is a wall relative to the rotation direction of the impeller 13 and extends in a normal direction with respect to the rotation trajectory of the impeller 13, and a curved surface 45*b*2 which is gradually distant in the radial direction of the impeller 13 as it comes closer to the wall surface 45*b*1 along the rotation direction of the impeller 13. According to this configuration, it is possible to make it easy for the foreign matter which is entrained in the rotation of the impeller 13 to be guided by the curved surface 45*b*2 and trapped on the wall surface 45*b*1, thereby staying in the shunting groove 45*b*. Furthermore, one corner disappears, and therefore, it is possible to make the relay flow path surface 44*b* wider than that of the form shown in FIG. 5A.

The shunting groove 45*c* shown in FIG. 5C is formed in a bag form. The shunting groove 45*c* has a return portion 45*c*1 which is gradually formed on the inner side in the radial direction of the impeller 13 along the rotation direction of the impeller 13 and faces in the direction opposite to the rotation direction of the impeller 13. According to this configuration, the trapped foreign matter can be reliably confined in the shunting groove 45*c*.

Figure 6:
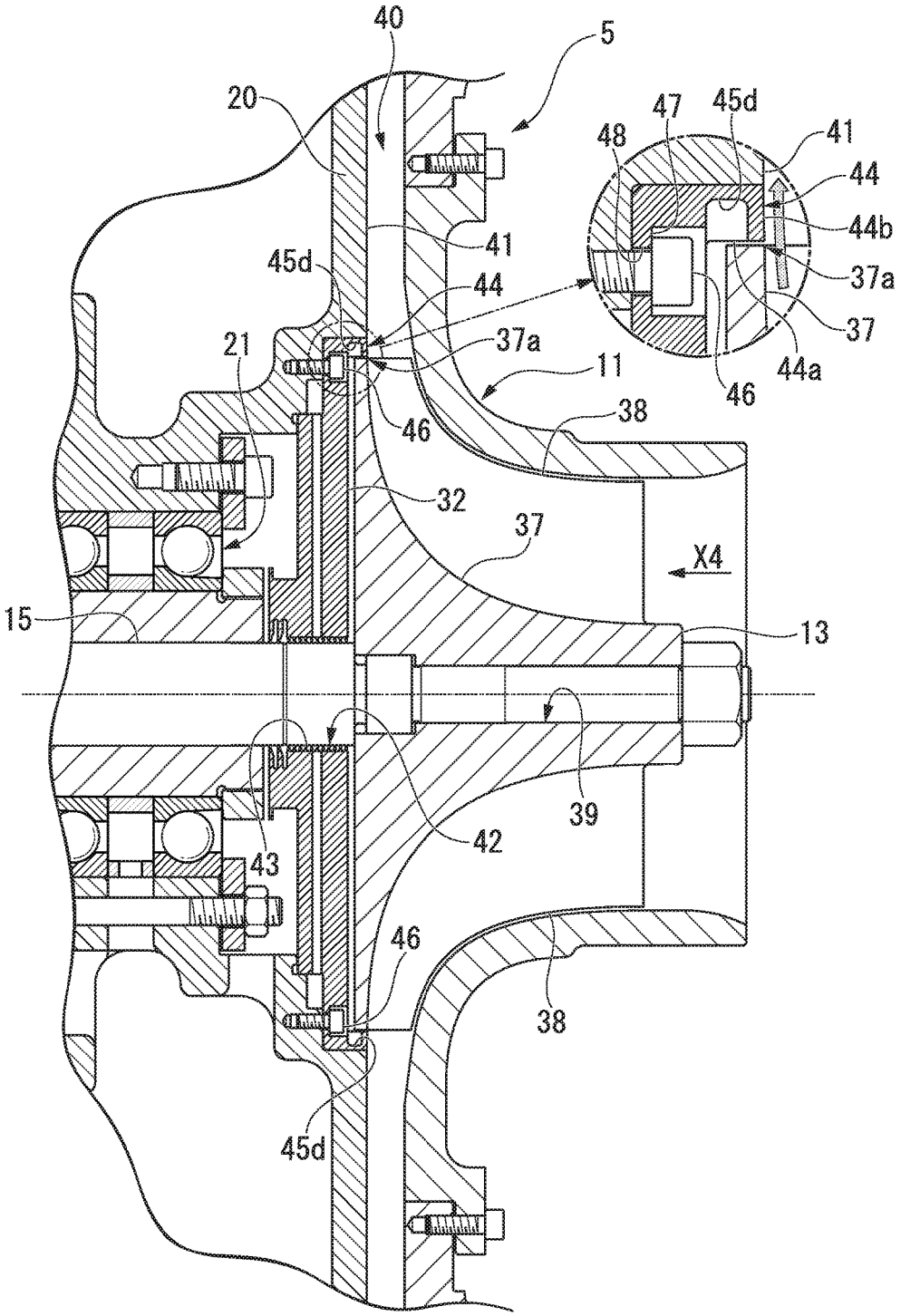
FIG. 6 is an enlarged view of a main section of a turbo compressor in another embodiment of the present invention.

FIG. 6 is an enlarged view of a main section of the turbo compressor 5 in another embodiment of the present invention.

As shown in FIG. 6, a shunting groove 45*d* is formed in only the facing surface 44*a* of the facing portion 44. That is, the shunting groove 45*d* is formed so as to gouge out the facing surface 44*a* of the facing portion 44 without shaving off the relay flow path surface 44*b* of the facing portion 44. According to this configuration, the hub 37 of the impeller 13 and the flow path surface 41 of the casing 20 smoothly communicate with each other over the entire area by the relay flow path surface 44*b* of the facing portion 44, and therefore, the ability of the refrigerant gas X4 to flow is not affected at all.

Figure 7:
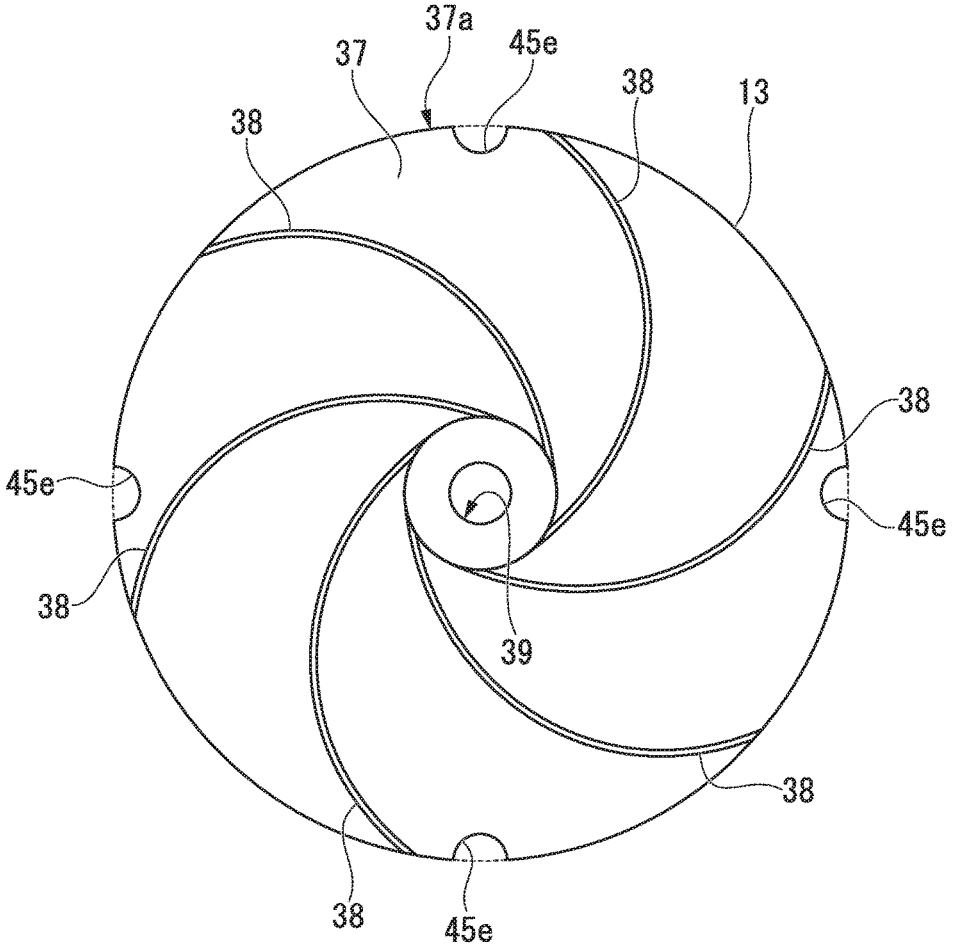
FIG. 7 is a diagram showing the disposition and the configuration of a shunting groove provided in an impeller in another embodiment of the present invention.

FIG. 7 is a diagram showing the disposition and the configuration of a shunting groove 45*e* provided in the impeller 13 in another embodiment of the present invention.

As shown in FIG. 7, the shunting groove 45*e* is provided in the impeller 13 which is a rotating body. The shunting groove 45*e* is a groove formed so as to partially gouge out the outer diameter portion 37*a* of the hub 37 toward the rotating shaft while avoiding the blade 38 of the impeller 13. The four shunting grooves 45*e* are formed at 90° intervals in the circumferential direction. According to this configuration, similar to the above-described embodiment, it is possible to prevent seizure due to the foreign matter becoming caught between the impeller 13 and the seal part 32.

Furthermore, for example, in the embodiments described above, a configuration in which the shunting groove 45 is formed in the impeller 13 or the seal part 32 has been described. However, the present invention is not limited to this configuration, and a configuration in which the shunting grooves 45 are formed in both the impeller 13 and the seal part 32 may be adopted.

Furthermore, for example, in the embodiments described above, a configuration in which the shunting groove 45 is formed in at least one of the impeller 13 and the seal part 32 has been described. However, the present invention is not limited to this configuration, and the shunting grooves 45 may also be likewise formed in the impeller 14 and the seal part 33 shown in FIG. 1.

Furthermore, for example, in the embodiments described above, a configuration in which a fixed member which faces the outer diameter portion 37*a* of the hub 37 of the impeller 13 in the radial direction is the seal part 32 has been described. However, the present invention is not limited to this configuration, and the fixed member may be the casing 20. For example, also in a case where a configuration of the related art is adopted, and thus the casing 20 and the impeller 13 are made to be the same members, and the casing 20 is made to face the outer diameter portion 37*a* of the impeller 13, by forming the shunting groove 45, it is possible to prevent seizure due to the foreign matter becoming caught between the impeller 13 and the casing 20.

INDUSTRIAL APPLICABILITY

According to the present invention, a turbo compressor and a turbo refrigerating machine are obtained in which it is possible to prevent seizure between an impeller and a fixed member.

REFERENCE SIGNS LIST

1: turbo refrigerating machine
2: condenser
4: evaporator
5: turbo compressor
13: impeller
15: rotating shaft
32: seal part (fixed member, labyrinth seal)
37: hub
37*a*: outer diameter portion
44: facing portion
45: shunting groove
45*a*: shunting groove
45*b*: shunting groove
45*c*: shunting groove
45*d*: shunting groove
45*e*: shunting groove
46: screw member
47: countersink

The invention claimed is:

1. A turbo compressor comprising:
an impeller which rotates about a rotating shaft; and
a fixed member which is provided with a facing portion which faces an outer diameter portion of a hub of the impeller in a radial direction,
wherein a shunting groove for foreign matter which has infiltrated between the outer diameter portion and the facing portion is formed in the fixed member,
the shunting groove is a countersink for a screw member fixing the fixed member, and
the countersink is formed around a through-hole into which the screw member is inserted.

2. The turbo compressor according to claim 1, wherein the shunting groove is partially formed in the facing portion of the fixed member.

3. The turbo compressor according to claim 1, wherein the fixed member is a labyrinth seal which seals the back side of the impeller.

4. The turbo compressor according to claim 1, wherein a plurality of the shunting grooves are formed, and
the shunting groove which is located on the lowermost side relative to direction of gravity, among the plurality of shunting grooves, is formed to be larger than the other shunting grooves.

5. The turbo compressor according to claim 1, wherein the impeller and the fixed member are formed of the same materials.

6. A turbo refrigerating machine comprising:
a condenser which liquefies a compressed refrigerant;
an evaporator which evaporates the refrigerant liquefied by the condenser, thereby cooling a cooling object; and
the turbo compressor according to claim 1, which compresses the refrigerant evaporated by the evaporator and supplies the compressed refrigerant to the condenser.

7. The turbo compressor according to claim 1, wherein
the shunting groove is a groove partially formed in the facing portion of the fixed member.

8. A turbo compressor comprising:
an impeller which rotates about a rotating shaft; and
a fixed member which is provided with a facing portion which faces an outer diameter portion of a hub of the impeller in a radial direction,
wherein a shunting groove for foreign matter which has infiltrated between the outer diameter portion and the facing portion is formed in the fixed member,
the shunting groove is partially formed in the facing portion of the fixed member,
the fixed member is a labyrinth seal which seals the back side of the impeller,
the shunting groove is a countersink for a screw member fixing the fixed member, and
the countersink is formed around a through-hole into which the screw member is inserted.

9. A turbo compressor comprising:
an impeller which rotates about a rotating shaft; and
a fixed member which is provided with a facing portion which faces an outer diameter portion of a hub of the impeller in a radial direction,
wherein a shunting groove for foreign matter which has infiltrated between the outer diameter portion and the facing portion is formed in the fixed member,
the shunting groove is partially formed in the facing portion of the fixed member, and
the shunting groove is a countersink for a screw member fixing the fixed member, and
the countersink is formed around a through-hole into which the screw member is inserted.

10. A turbo compressor comprising:
an impeller which rotates about a rotating shaft; and
a fixed member which is provided with a facing portion which faces an outer diameter portion of a hub of the impeller in a radial direction,
wherein a shunting groove for foreign matter which has infiltrated between the outer diameter portion and the facing portion is formed in the fixed member,
the shunting groove is partially formed in the facing portion of the fixed member,
the shunting groove is a countersink for a screw member fixing the fixed member,
a plurality of the shunting grooves are formed, and
the shunting groove which is located on the lowermost side relative to direction of gravity, among the plurality of shunting grooves, is formed to be larger than the other shunting grooves.

11. A turbo compressor comprising:
an impeller which rotates about a rotating shaft; and
a fixed member which is provided with a facing portion which faces an outer diameter portion of a hub of the impeller in a radial direction,
wherein a shunting groove for foreign matter which has infiltrated between the outer diameter portion and the facing portion is formed in the fixed member,
the shunting groove is partially formed in the facing portion of the fixed member,
a plurality of the shunting grooves are formed, and
the shunting groove which is located on the lowermost side relative to direction of gravity, among the plurality of shunting grooves, is formed to be larger than the other shunting grooves.

12. A turbo compressor comprising:
an impeller which rotates about a rotating shaft; and
a fixed member which is provided with a facing portion which faces an outer diameter portion of a hub of the impeller in a radial direction, wherein a shunting groove for foreign matter which has infiltrated between the outer diameter portion and the facing portion is formed in the fixed member, the shunting groove is partially formed in the facing portion of the fixed member, the fixed member is a labyrinth seal which seals the back side of the impeller, the shunting groove is a countersink for a screw member fixing the fixed member, a plurality of the shunting grooves are formed, and the shunting groove which is located on the lowermost side relative to direction of gravity, among the plurality of shunting grooves, is formed to be larger than the other shunting grooves.

13. A turbo compressor comprising:

an impeller which rotates about a rotating shaft; and a fixed member which is provided with a facing portion which faces an outer diameter portion of a hub of the impeller in a radial direction, wherein a shunting groove for foreign matter which has infiltrated between the outer diameter portion and the facing portion is formed in the fixed member, the shunting groove is partially formed in the facing portion of the fixed member, the fixed member is a labyrinth seal which seals the back side of the impeller, a plurality of the shunting grooves are formed, and the shunting groove which is located on the lowermost side relative to direction of gravity, among the plurality of shunting grooves, is formed to be larger than the other shunting grooves.

14. A turbo compressor comprising:

an impeller which rotates about a rotating shaft; and a fixed member which is provided with a facing portion which faces an outer diameter portion of a hub of the impeller in a radial direction, wherein a shunting groove for foreign matter which has infiltrated between the outer diameter portion and the facing portion is formed in the fixed member, the fixed member is a labyrinth seal which seals the back side of the impeller, the shunting groove is a countersink for a screw member fixing the fixed member, a plurality of the shunting grooves are formed, and the shunting groove which is located on the lowermost side relative to direction of gravity, among the plurality of shunting grooves, is formed to be larger than the other shunting grooves.

15. A turbo compressor comprising:

an impeller which rotates about a rotating shaft; and a fixed member which is provided with a facing portion which faces an outer diameter portion of a hub of the impeller in a radial direction, wherein a shunting groove for foreign matter which has infiltrated between the outer diameter portion and the facing portion is formed in the fixed member, the fixed member is a labyrinth seal which seals the back side of the impeller, a plurality of the shunting grooves are formed, and the shunting groove which is located on the lowermost side relative to direction of gravity, among the plurality of shunting grooves, is formed to be larger than the other shunting grooves.

16. A turbo compressor comprising:

an impeller which rotates about a rotating shaft; and a fixed member which is provided with a facing portion which faces an outer diameter portion of a hub of the impeller in a radial direction, wherein a shunting groove for foreign matter which has infiltrated between the outer diameter portion and the facing portion is formed in the fixed member, the shunting groove is a countersink for a screw member fixing the fixed member, a plurality of the shunting grooves are formed, and the shunting groove which is located on the lowermost side relative to direction of gravity, among the plurality of shunting grooves, is formed to be larger than the other shunting grooves.

* * * * *